US005662217A

United States Patent [19]

Durr

[11] Patent Number: 5,662,217

[45] Date of Patent: Sep. 2, 1997

[54] COMPACT DISC SLEEVE PACKAGE

[76] Inventor: Nicole Durr, 2200 N. Florida Mango Rd., West Palm Beach, Fla. 33409

[21] Appl. No.: 605,903

[22] Filed: Feb. 23, 1996

[51] Int. Cl.[6] ..... B65D 85/57

[52] U.S. Cl. ..... 206/308.1; 206/312; 229/68.1

[58] Field of Search ..... 206/307.1, 308.1, 206/308.2, 308.3, 312, 387.13; 229/68.1

[56] References Cited

U.S. PATENT DOCUMENTS

| | | | |
|---|---|---|---|
| D. 304,781 | 11/1989 | Hanson . | |
| D. 327,638 | 7/1992 | Denkin . | |
| 4,905,831 | 3/1990 | Bagdis et al. | 206/308.3 |
| 5,147,036 | 9/1992 | Jacobs . | |
| 5,154,284 | 10/1992 | Starkey . | |
| 5,219,417 | 6/1993 | O'Brien et al. . | |
| 5,236,081 | 8/1993 | Fitzsimmon et al. . | |
| 5,248,032 | 9/1993 | Sheu et al. | 206/308.1 |
| 5,255,785 | 10/1993 | Mackey | 206/308.3 |

FOREIGN PATENT DOCUMENTS

| | | | |
|---|---|---|---|
| 6-255694 | 9/1994 | Japan | 206/308.3 |
| 93/21086 | 10/1993 | WIPO | 206/312 |
| 94/19805 | 9/1994 | WIPO | 206/308.3 |

*Primary Examiner*—Jimmy G. Foster
*Attorney, Agent, or Firm*—McHale & Slavin, P.A.

[57] ABSTRACT

A specially constructed sleeve for the low cost and space efficient packaging, containment, and displaying of compact discs (CD's) which includes a unitary sheet of material which is folded to form a CD containment sleeve and cover with a flap. The sleeve is formed by folding tabs over a middle section and then folding an adjoined end section over onto the tabs. The end section is then adhered to the tabs to form a CD containment sleeve. The sleeve includes a horizontal slot for receiving the flap of cover section as it wraps around the containment sleeve. Various surfaces of the sleeve can also receive printed indicia, either directly or via later applied indicia printed adhesive labels.

9 Claims, 2 Drawing Sheets

COMPACT DISC SLEEVE PACKAGE

FIELD OF THE INVENTION

This invention relates generally to the packaging of compact discs and, more particularly to a sleeve for the low cost and space efficient packaging, containment, and displaying of compact discs (CD's).

BACKGROUND OF THE INVENTION

Prerecorded or recordable optical audio discs, commonly referred to as "CD's", are in common use. A five inch standard size is typically used for musical recordings and storage of data for reading by a computer. Packaging of CD's has previously included a hard plastic box, often referred to as a "longbox" which in turn holds a smaller, rigid plastic case that contains the CD. The longbox was originally created to facilitate store shelf display of CD's and to create a package large enough to deter theft of the relatively small CD's. The longbox and internal plastic case, however, have generally been perceived as a waste of material which proves to be both uneconomical for the manufacturer and unsound for the environment. Many stores have even taken to removing the CD's from their longboxes before displaying them on their shelves. Consumer's have been shown to prefer the smaller packaging and generally appreciate the conservation efforts taken by the store.

The use of a plastic case is also perceived by many to be a waste of material which in turn presents ecological problems upon disposal. The case is bulky in itself and has sharp corners which can scratch other objects (e.g. automobile or furniture surfaces) which come in contact with the plastic cases. In most instances, a CD does not need the amount of protection offered by such a plastic case. A CD is a durable, rigid plastic object in and of itself and is generally stronger than its surrounding plastic case due to the CD's lack of dimensional shape. However, a CD is susceptible to performance degrading scratches on its optical side. A high impact blow to a CD stored in a plastic case might, in fact, shatter the relatively thin cover of a plastic case. Additionally, the hinge of a standard plastic CD case is known in the art to be fragile and an entire after market exists for empty, replacement plastic CD cases due to breakage of the hinge and of the box.

Attempts have been made in the prior art to develop other forms of CD holders. U.S. Pat. No. 5,147,036 discloses a compact disc packaging scheme which includes a separate envelope for receiving a CD and a protective jacket having a pouch for receiving the protective envelope. This two part system is difficult to use and expensive to manufacture.

U.S. Pat. No. 5,219,417 discloses a CD package consisting of a plastic holder with a pair of non-plastic panels which fold over the ends of the holder. U.S. Pat. No. 5,236,081 discloses a pair of flip panels which convert a plastic holder into a longbox format. These hybrid constructs still involve the use of plastic parts which are environmentally harmful and difficult to dispose.

Design Pat. Nos. 304,781 and 327,638 disclose CD envelopes with clear observation windows, however, such envelopes provide minimal protection to the CD contained therein. Furthermore, such envelopes are fixed per their specific designs, which do not include wallet-like containment systems.

U.S. Pat. No. 5,154,284 discloses a compact disc package which is constructed like a double fold matchbook cover. A disc is contained in a notched sleeve which is formed by folding and adhering a portion of the cover over upon itself. After formation of the sleeve, the cover contains two folds so that a front and back cover exist to surround the sleeve portion. This double fold system utilizes extra material to create a second fold and separate cover that adds expense and complexity to the device.

Hence a CD holder or sleeve is needed which is inexpensive to construct and efficiently stores CD's of varying sizes in a single packaging scheme. This holder or sleeve should use a minimum amount of folded, non-plastic material to achieve its necessary storage and display purposes.

SUMMARY OF THE INVENTION

The present invention provides a CD packaging sleeve constructed from a unitary piece of heavy gauged paper, cardstock, or fiberboard. The CD packaging sleeve involves only one major fold to form a single-fold, wallet-like envelope with a sleeve portion and a folding front cover. The cover has a flap which tucks into a slot cut into the sleeve portion. The front and back of the sleeve portion, as well as the front and back of the cover portion, might also be used as surfaces for display of indicia. This indicia could be printed directly on the CD packaging materials or printed separately and later adhered to the packaging materials.

It is therefore an object of the present invention to provide a CD packaging sleeve, as formed from a unitary piece of material, which minimizes the material necessary to effectively and safely package a CD.

It is a further object of the present invention to provide a CD packaging sleeve which utilizes a single-fold design with a sleeve and cover portion.

It is yet another object of the present invention to provide a sleeve portion as formed by folding a portion of the unitary material over upon itself and adhering the folded portion to a pair of winged tabs which have been folded underneath.

It is still a further object of the present invention to provide surfaces for display of indicia.

It is yet another related object of the present invention to provide separate printed materials for adhesion to the CD packaging material.

Another object of the present invention is to provide a folding tab and a containment slot for closing the CD package.

Other objects and advantages of this invention will become apparent from the following description taken in conjunction with the accompanying drawings wherein set forth, by way of illustration and example, are certain embodiments of this invention. The drawings constitute a part of this specification and include exemplary embodiments of the present invention and illustrate various objects and features thereof.

DETAILED DESCRIPTION OF THE PREFERRED EMBODIMENT

Although the invention is described in terms of a preferred specific embodiment, it will be readily apparent to those skilled in this art that various modifications, rearrangements and substitutions can be made without departing from the spirit of the invention. The scope of the invention is defined by the claims appended hereto.

Figure 1:
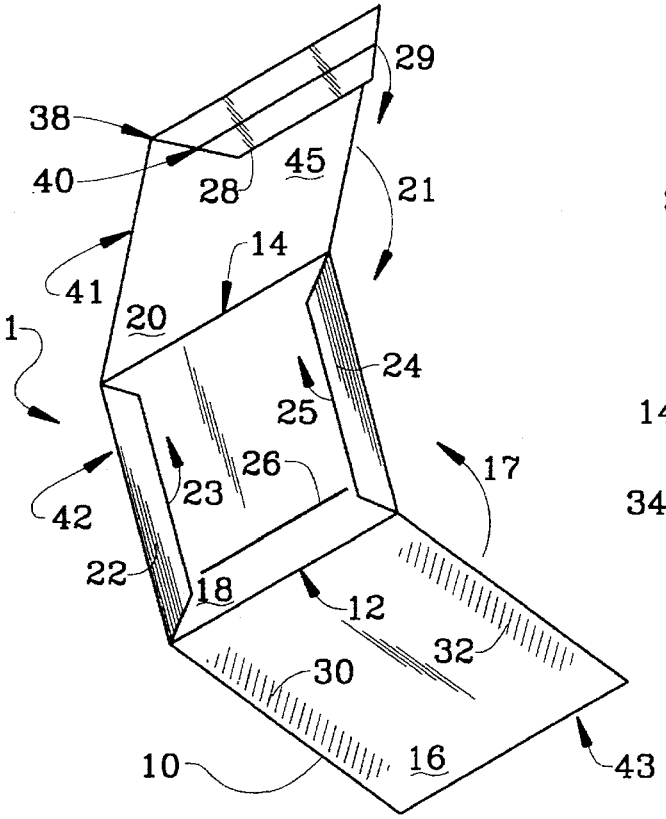
FIG. 1 is a pictorial front view of the unitary sheet of CD packaging material with the appropriate folds indicated to form the CD packaging sleeve.

Referring now to FIG. 1, a pictorial view of the CD packaging sleeve 1 is shown with the unitary sheet 10 being folded into its operational shape. The unitary sheet 10 is partitioned off into three substantially square sections 16, 18, and 20. The package formation consists of a first fold 12 between the first section 16 and the second section 18 whereby section 16 folds over upon section 18, as shown by arrow 17. Section 18 has tabs 22 and 24 which fold over upon section 18 as shown by arrows 23 and 25. Tabs 22 and 24 are folded over first, with section 16 folding over upon the tabs and being adhered to the adjoining surfaces 30 and 32 on the inner surface of section 16.

The tabs allow the width of the CD sleeve to be approximately the diameter of the largest CD that one might expect to store in the package (e.g. standard 5 inch CD's). Without the tabs, section 16 would have to be adhered directly to the adjoining surface of section 18 and the adhered (or stapled) sections would interfere with the usable storage area in the formed sleeve for the CD's. Additionally, the tabs provide a spacer means between sections 16 and 18 which allows for easier insertion and removal of a CD. The tabs might be cut with angular edges to facilitate easier folding of section 16 over the folded tabs.

Figure 2:
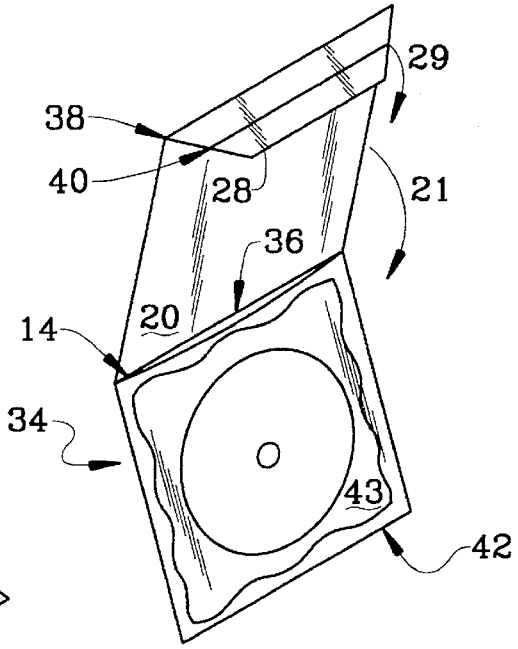
FIG. 2 is a pictorial front view of the formed CD packaging sleeve with the cover opened.

Referring also to FIG. 2, a cover section 20 folds over the formed sleeve portion 34 along the major fold 14, as shown by arrow 21. The cover 20 serves to close and contain the slot 36 formed for insertion of the CD. This fold defines the single fold, wallet-like character of the formed package.

Figure 3:
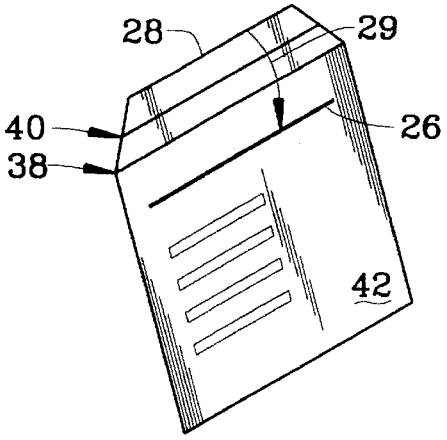
FIG. 3 is pictorial back view of the formed CD packaging sleeve showing the slot for insertion of the tab.
Figure 3A:
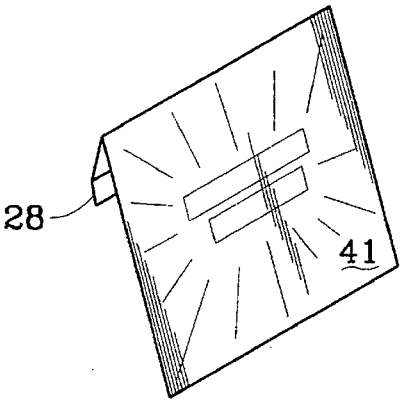
FIG. 3A is a pictorial front view of the formed CD packaging sleeve showing the closing flap outside of its receiving slot.

Referring now FIGS. 1 and 2, the flap 28 is shown to fold over section 20 via fold 38, as shown by arrow 29. The flap 28 includes an additional fold 40 to facilitate tucking the lower portion of the flap into a slot 26 cut into section 18. FIG. 3 additionally shows that as cover 20 is folded over the sleeve portion 34, flap 28 wraps around the back side 42 of sleeve portion 34 to encounter the receiving slot 26. As shown by arrow 29, the flap 28 encounters slot 26 so that a portion of flap 28 is receivably contained in the slot. FIG. 3A additionally shows the front side 41 of the sleeve portion 34, with the flap 28 shown untucked into its receiving slot 26.

Figure 4:
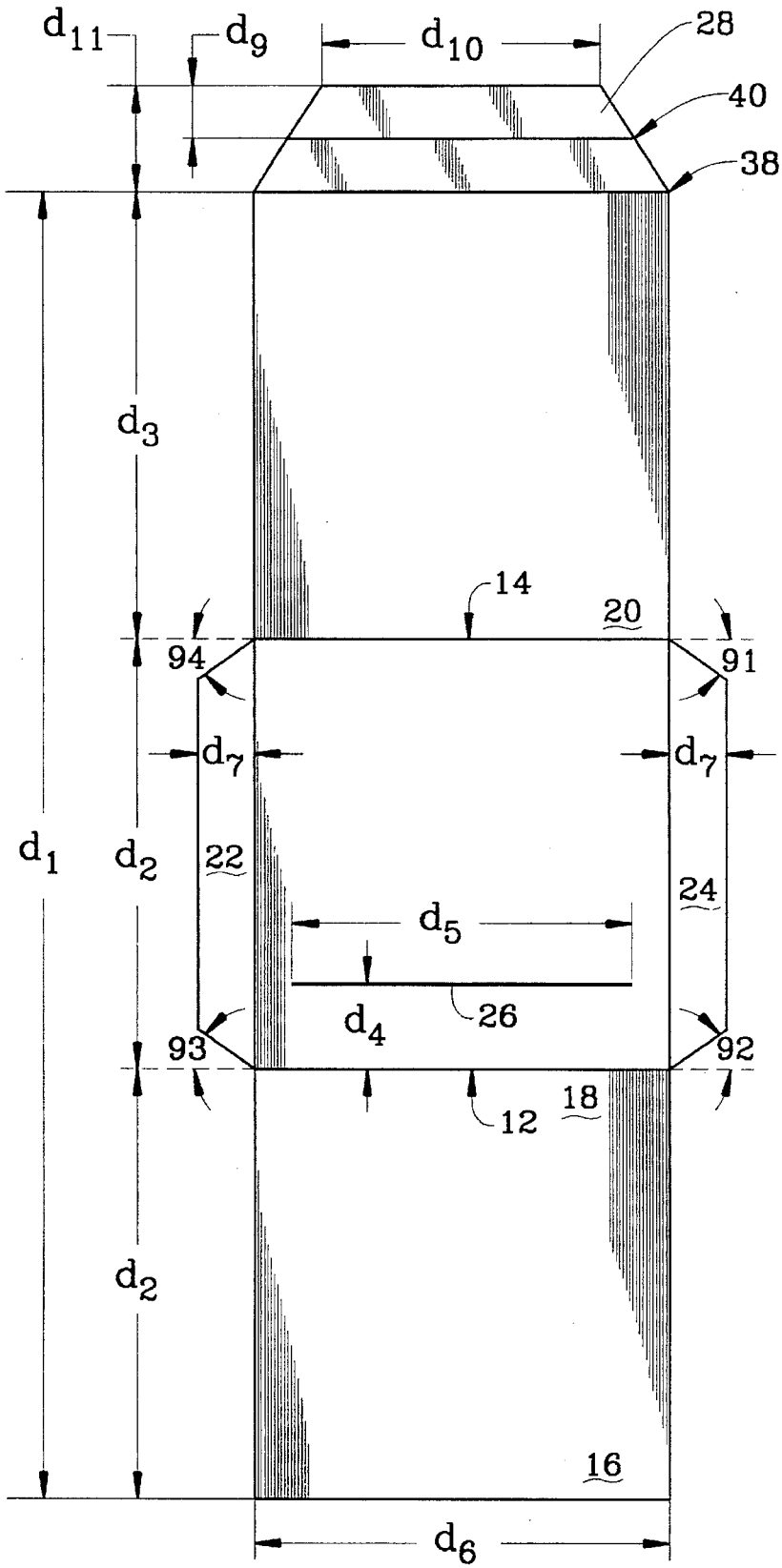
FIG. 4 is a front view of the flat unitary sheet of material that is used to form the CD packaging sleeve.

Referring now to FIG. 4, a detailed layout is shown of the unitary piece of material which is used to construct the CD packaging sleeve. The three substantially square sections 16, 18, and 20 each have the following dimensions: section 16=d2 by d6; section 18=d2 by d6; and section 20=d3 by d6; wherein d3 and d6 are very slightly larger than d2. Hence the length of the unitary piece, without the flap d1, is equal to d2+d2+d3. The slightly differing sizes of the square sections facilitates the formation of a package whereby the CD is easily inserted and removed, and the package is easily folded and used. Flap 28 measures d11 in length with fold 40 occurring a length d12 from the end. Flap 28 tapers down to a width d10.

The tabs 22 and 24 extend outward (left and right) from section 18 a distance d7. While these tabs might be squared at the ends, the preferred embodiment uses angular cuts a1, a2, a3, and a4 on the tab ends to facilitate easier folding and formation of the CD packaging sleeve. One embodiment might include angles a2 and a3 being cut at approximately 10 to 15 degrees, with angles a1 and a4 being zero degrees (or squared off). The shown embodiment includes all 4 angles being cut the same degree, e.g. 10 to 15 degrees.

The slot 26 is located a distance d4 from the fold 12 separating sections 16 and 18. Slot 26 is centered between the tabbed ends 22 and 24 and measures a width d5 across.

While these relative dimensions might be used in any combination to achieve the teachings and advantages of the present invention, the preferred embodiment uses the following measurements (in metric): d1=419 mm; d2=127 mm; d3=128; d4=23 mm; d5=87 mm; d6=128 mm; d7=20 mm; d10=67 mm; d11=37 mm; d12=17 mm. Additionally, angles a1–a4 are each cut at 10 or 15 degrees.

The CD packaging sleeve might also carry printed indicia on its various surfaces to convey information and/or attract a consumer to the product. These printed indicia might be printed directly on the unitary sleeve material. Alternatively, the shown and preferred embodiment uses separately printed sheets of printed indicia which adhere to the surfaces of the unitary sheet 10. The configuration allows for mass production of the unitary sheets 10 which can then be individually customized by adding the appropriate printed indicia labels. As shown, convenient surfaces for receiving such indicia include: surface 41, the front, outward appearing side of the cover section 20; surface 43, the front of the formed sleeve portion 34; and surface 42, the rear of the formed sleeve portion 34. These indicia might appear in any orientation and might also appear on surface 45, the inward appearing side of cover section 20.

It is to be understood that while I have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What is claimed is:

1. A compact disc containment package comprised of:

a CD containing sleeve formed from a unitary rectangular sheet of material with longitudinal ends and widthwise sides, said sheet being divided into three adjoining sections including a middle section of about 127 mm by 128 mm, an end section of about 127 mm by 128 mm, and a cover section of about 128 mm×128 mm, said cover section including said sealing flap extending from its end, and said middle section including a folding tab of about 20 mm with angle ends disposed on each side and a widthwise slot for receiving said sealing flap;

wherein said CD containing sleeve is formed by:

folding said tabs over onto said middle section, and then folding said end section over upon said tabs and permanently securing the tabs to the contacting portions of said folded end section; and wherein said package is sealed by folding said cover section over said formed sleeve so that said flap wraps around and is received by said middle section receiving slot.

2. The compact disc containment package of claim 1, wherein said flap on said cover section includes a jointed fold to facilitate insertion into said receiving slot.

3. The compact disc containment package of claim 1, wherein said unitary sheet material includes card stock.

4. The compact disc containment package of claim 1, wherein said unitary sheet material includes fiberboard.

5. The compact disc containment package of claim 1, wherein the following section surfaces include printed indicia materials positioned on the exposed front of said end section, the exposed rear of said middle section; and the exposed front of said cover section.

6. The compact disc containment package of claim 5, wherein said printed indicia materials are printed directly on said section surfaces.

7. The compact disc containment package of claim 5, wherein said printed indicia materials are printed on separate labels for attachment to said section surfaces.

8. The compact disc containment package of claim 5, wherein the following additional surface includes printed indicia materials: the inner side of said cover section.

9. The compact disc containment package of claim 1, wherein said tab ends are angled inward ranging from zero degrees to 15 degrees.

* * * * *